United States Patent [19]

Park et al.

[11] Patent Number: 4,594,922

[45] Date of Patent: Jun. 17, 1986

[54] CLOSED END JAW WRENCH

[76] Inventors: Sea C. Park; In P. Park, both of 3836 Birchwood, Skokie, Ill. 60076

[21] Appl. No.: 715,161

[22] Filed: Mar. 22, 1985

[51] Int. Cl.[4] ..... B25B 13/28

[52] U.S. Cl. ..... 81/99

[58] Field of Search ..... 81/98, 99, 92, 94, 97

[56] References Cited

U.S. PATENT DOCUMENTS 897,665 9/1908 Rugg ..... 81/99

4,084,456 4/1978 Pasbrig ..... 81/98

FOREIGN PATENT DOCUMENTS 83132 4/1935 Sweden ..... 81/99

*Primary Examiner*—James L. Jones, Jr.

*Attorney, Agent, or Firm*—Birch, Stewart, Kolasch & Birch

[57] ABSTRACT

A closed end jaw wrench comprising a body member having an upper jaw disposed at one end and a locking member at the other end thereof, a handle member pivotally connected to the body member, a closed end jaw forming a hexagon pivotally connected to the body member, biasing spring disposed between the body and the handle for biasing the handle away from said body, the handle containing a lever end portion which slidably engages a surface of the closed end jaw for separating the upper jaw of the body from the lower jaw of the closed end jaw through the releasing of the handle from the body against the bias of the extension spring, and a retaining spring attached at one end to the body and at the other end of the spring engaging space of the closed end jaw, whereby, when the handle is squeezed, the upper jaw of the body is caused to close toward the lower jaw by the action of the retaining spring.

3 Claims, 2 Drawing Figures

CLOSED END JAW WRENCH

BACKGROUND OF THE INVENTION

The invention relates to a closed end jaw wrench and more particularly to a wrench having a closed end jaw, which can be more tightly closed around an object and operated with little effort being required by the user.

There are many types of wrenches which are well known in the art which utilize a retaining spring for closing the jaws of the wrench. However, these wrenches suffer from a number of difficulties such as, for example, they are complicated in structure, expensive to manufacture, and in many cases, are difficult to operate in that several different operational steps are required to apply pressure, retain pressure and release the pressure from the object to which the wrench is being applied. Furthermore, in these devices, the thumb must be utilized to open the mouth of the wrench against the bias of a spring and then the thumb is released to permit the jaws of the wrench to close around the desired object.

In some instances, there is the problem whereby the object tends to slip from the wrench while it is being used.

OBJECT AND SUMMARY OF THE INVENTION

Accordingly, it is an object of the present invention to provide an improved closed end jaw wrench.

Another object of the present invention is to provide a wrench which is easy and tight to operate and possesses a strong grasping power.

A further object of the present invention is to provide a wrench which will not slip from the object when the wrench is operated.

Still another object of the present invention is to provide a wrench which can be closed on a thin nut such as a jam nut.

Yet another object of the present invention is to provide a wrench with a handle which can be readily locked to an object or readily released from a body.

Other objects and further scope of applicability of the present invention will become aparent from the detailed description given hereinafter.

It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention provides a closed end jaw wrench which is simple to manufacture, and easy to operate and apply its tighting and grasping power as the wrench is applied to an object.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE DRAWINGS

Figure 1:
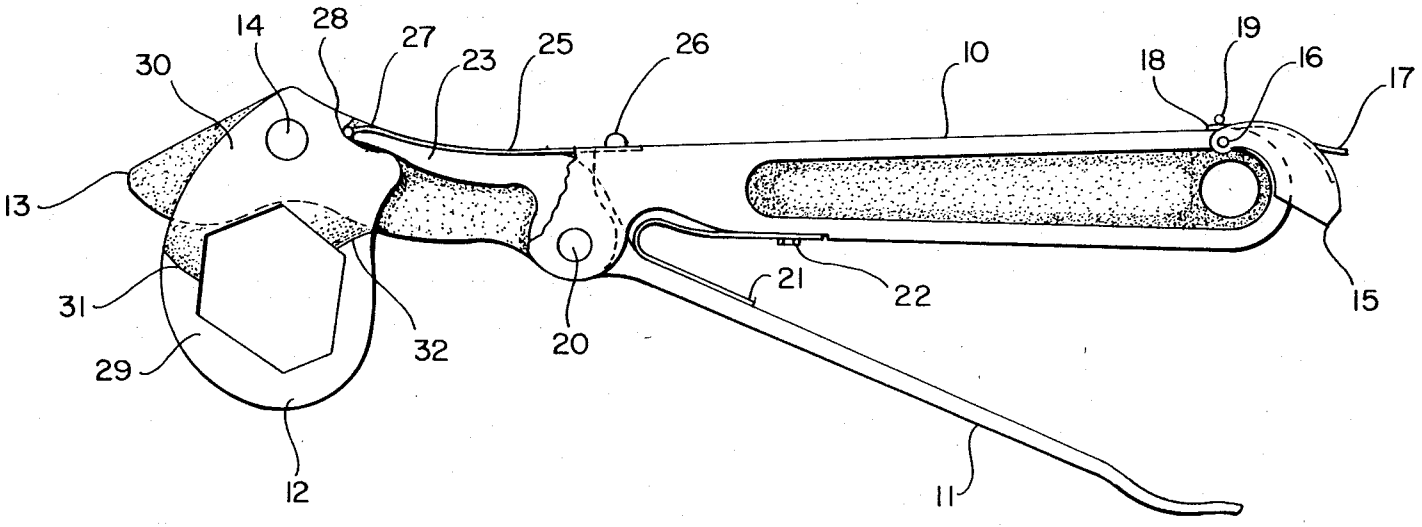
FIG. 1 is a side view of the wrench of the present invention showing the closed end jaw of the wrench in an open position.
Figure 2:
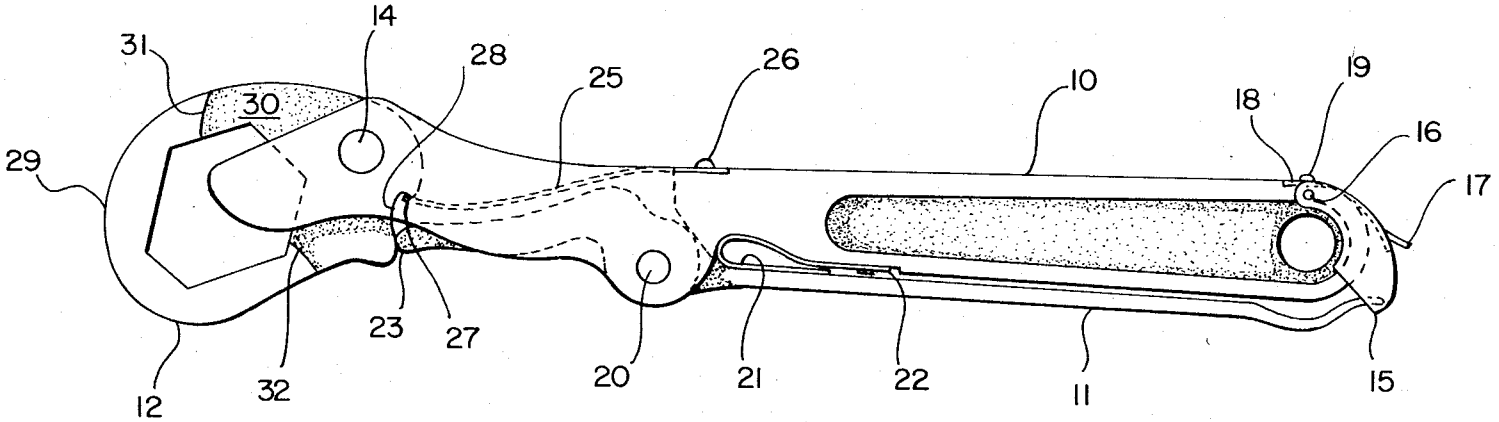
FIG. 2 is a side view of the wrench of the present invention showing the closed end jaw of the wrench in a closed position and the handle in a locked position against the body of the wrench.

Referring in detail to the drawing for the purpose of illustrating the present invention, the closed end jaw wrench in FIGS. 1 and 2 comprises a body 10, a handle 11, and closed end jaw 12.

The body 10 is provided with an upper jaw 13 disposed at one end thereof which is pivotally fixed to the closed end jaw 12 by a pivot pin 14. The other end of the body 10 is provided with a lock member 15 secured thereto by a bolt 16. The lock member 15 is provided with a small handle 17 attached to it and a spring 18 which is fixed to the body 10 by a screw 19. The lock member is used to lock the handle 11 to the body 10.

The handle 11 is pivotally connected to the body 10 by a pivot pin 20.

Also, the handle 11 is biased away from the body 10 by an extension spring 21 which is attached to the body 10 by a pin member 22. To open the closed end jaw 12 of the wrench, the handle 11 is released from the body 10 and the biased spring 21 causes a lever end portion 23 of the handle 11 to travel along the surface 24 of the closed end jaw 12 causing the upper jaw 13 to open away from the lower jaw 12.

After the closed end jaw 12 of the wrench has been positioned around a desired object, that is, the desired object has been put into the jaw ring 12, the handle 11 is squeezed toward the body 10 drawing the closed end jaw 12 around the object and toward the upper jaw 13.

A retaining spring 25 is attached to the body 10 by screw member 26. The retaining spring 25 contains an indent portion 27 at the end thereof for engagement with the protrusion surface 28 disposed on the closed end jaw 12. The retaining spring 25 is strongly biased against the closed end jaw 12 to resist the closing of the closed end jaw 12 and the upper jaw 13 so that when the handle 11 is squeezed, the retaining spring 25 strongly pulls the closed end jaw 12 away from the upper jaw 13. At that time, both jaws strongly close around the object so that the object cannot be readily released from the wrench.

The closed end jaw 12 which, as a hexagon configuration, comprises thick and thin portions 29, 30 thereof. The front portion 29 of the closed end jaw 12 disposed from line 31 to line 32 is thicker than the rear portion 30 of the closed end jaw 12 so that any nut of lower height such as a jam nut, can be operated by the wrench of the present invention.

Because the jaws of the wrench of the present invention can be easily opened by releasing the handle 11, the jaws of the wrench can be easily manipulated around any size object. Also, by squeezing the handle 11 the jaws of the wrench are automatically and strongly closed around an object, no matter what its size.

Accordingly, since the spring performs the squeezing motion of the wrench jaws, the wrench can be operated with little effort by the user.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A closed end jaw wrench comprising:

a body member having an upper jaw disposed at one end thereof, a handle member pivotally connected to said body member, a lock attached to said body member, whereby said handle member can be locked to the body member, a closed end jaw member having a hexagon configuration pivotally connected to said body member, biasing spring disposed between said body member and said handle member for biasing the handle member away from the body member, the handle member containing a lever engaging end portion which engages the base engaging surface of the closed end jaw for separating the upper jaw of the body member from the closed end jaw by releasing of the handle and permitting the biased spring to separate the handle from the body, and a retaining spring is attached at one end to said body and at the other end to a protrusion portion of the surface of the closed end jaw, whereby, when the handle is squeezed, the upper jaw of the body member is caused to close toward the closed end jaw against the action of the retaining spring.

2. The closed end jaw wrench of claim 1, wherein the lock member disposed at one end of said body member contains a spring for locking said handle member to the body.

3. The closed end jaw wrench of claim 1, wherein the closed end jaw member has a thick front portion and a thin rear portion thereof, whereby, the wrench can also be used to close around a nut of lower height such as a jam nut.

* * * * *